US011297996B2

(12) United States Patent
Metzel et al.

(10) Patent No.: US 11,297,996 B2
(45) Date of Patent: Apr. 12, 2022

(54) FLOOR MOP

(71) Applicant: Carl Freudenberg KG, Weinheim (DE)

(72) Inventors: Doug Metzel, Lombard, IL (US); Eric Wehrli, Oswego, IL (US)

(73) Assignee: Carl Freudenberg KG, Weinheim (DE)

( * ) Notice: Subject to any disclaimer, the term of this patent is extended or adjusted under 35 U.S.C. 154(b) by 264 days.

(21) Appl. No.: 16/528,050

(22) Filed: Jul. 31, 2019

(65) Prior Publication Data

US 2021/0030252 A1 Feb. 4, 2021

(51) Int. Cl.
*A47L 13/254* (2006.01)
*A47L 13/256* (2006.01)

(52) U.S. Cl.
CPC ..... *A47L 13/254* (2013.01); *A47L 13/256* (2013.01)

(58) Field of Classification Search
CPC .... A47L 13/254; A47L 13/256; A47L 13/257; A47L 13/24; A47L 13/22; A47L 13/225; A47L 13/20
USPC ..... 15/248.1, 144.2
See application file for complete search history.

(56) References Cited

U.S. PATENT DOCUMENTS 1,989,825 A * 2/1935 Schaefer ..... A47L 13/252 15/228
3,775,802 A 12/1973 Grassman et al.
3,795,933 A * 3/1974 Seufert ..... A47L 13/12 15/114
6,579,023 B2 * 6/2003 Kunkler ..... A47L 13/22 401/138
7,237,295 B2 * 7/2007 Lindholm ..... A47L 13/258 15/147.2
8,230,545 B2 * 7/2012 Lee ..... A46B 5/00 15/228
2007/0107153 A1 5/2007 Gullicks et al.
2018/0042444 A1 * 2/2018 Metzel ..... A47L 13/256

FOREIGN PATENT DOCUMENTS

DE 10123522 C1 8/2002
WO WO 2007/092508 * 8/2007 ..... A47L 13/512

OTHER PUBLICATIONS

European Patent Office, International Search Report in International Patent Application No. PCT/IB2020/057034, 4 pp. (dated Oct. 20, 2020).
European Patent Office, Written Opinion in International Patent Application No. PCT/IB2020/057034, 6 pp. (dated Oct. 20, 2020).

* cited by examiner

*Primary Examiner* — Laura C Guidotti
(74) *Attorney, Agent, or Firm* — Leydig, Voit & Mayer, Ltd.

(57) ABSTRACT

A floor mop including a handle, a shaft coupled to the handle, a multidirectional joint coupled to the shaft opposite the handle, and a mop plate. The mop plate is unitarily formed and includes an upper plate including an upper surface, a substantially parallel lower plate including a lower surface, lateral faces extending between the upper and lower plate, and at least one internal web extending between the upper and lower plates. The upper plate, lower plate, lateral faces and at least one internal web are unitarily formed. The mop plate and the multidirectional joint further include complementary coupling structures.

17 Claims, 9 Drawing Sheets

FLOOR MOP

FIELD OF THE DISCLOSURE

The present disclosure relates to floor mops, spray mops and similar devices.

BACKGROUND OF THE INVENTION

Floor sweepers or mops may be used dry or in conjunction with a liquid or spray material that aids cleaning with the mop. Spray mops are typically constructed with a flat plate, upon which a cover is disposed. The cover may be formed of a synthetic or natural fabric or the like, or combinations thereof. The cover both provides scrubbing action on a surface to be cleaned and absorbent and/or attractive qualities to pick up and retain both solids and liquids.

The plate of the mop is typically attached at a central portion thereof to a shaft and handle via a universal or multidirectional joint that provides freedom of movement in multiple directions between the shaft and the plate such that a user can easily direct the mop plate along a desired path. Because the shaft is attached to the plate at a central portion thereof, the downforce exerted by the user and the weight of the device tends to be greatest in the center of the plate and relatively less in areas of the plate that are radially peripheral relative to the center of the plate.

SUMMARY OF THE DISCLOSURE

In one aspect, the disclosure describes a floor mop including a handle, a shaft coupled to the handle, a multidirectional joint coupled to the shaft opposite the handle, and a mop plate coupled to the multidirectional joint. The mop plate and the multidirectional joint including complementary coupling structures. The mop plate further includes an upper plate, a lower plate substantially parallel to the upper plate, lateral faces extending between the upper and lower plate, and at least one internal web extending between the upper and lower plates. The upper plate includes an upper surface, and the lower plate includes a lower surface. The upper plate, lower plate, lateral faces and at least one internal web of the mop plate are unitarily formed.

In another aspect, the disclosure describes a floor mop including a handle, a shaft coupled to the handle, a multidirectional joint coupled to the shaft opposite the handle, and a mop plate coupled to the multidirectional joint. The mop plate and the multidirectional joint include complementary coupling structures. The mop plate also includes a substantially planar upper plate, a substantially planar lower plate disposed substantially parallel to the upper plate, lateral faces extending between the upper and lower plate, and a plurality of internal webs extending between the upper and lower plates. The mop plate further includes a front edge and a rear edge. The plurality of internal webs extend in a direction between the front and rear edges and are disposed substantially parallel one another. The upper plate, lower plate, lateral faces and the internal webs of the mop plate are unitarily formed.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration as used herein refer to a relative structural size and shape capable of a particular function or operation.

The invention is directed to a floor mop, which may be a spray mop. The spray mop has a structure suitable for use as either a wet mop or a dry mop. When used as a wet mop, the spray mop is able to project a fluid, such as a cleaning solution, in front of the mop and onto a surface for cleaning. The spray mop can then be guided over the surface by the user to clean the surface. While a spray mop is illustrated and discussed below, it will be appreciated that this disclosure applies equally to a floor mop that does not include a spray device.

Figure 1:
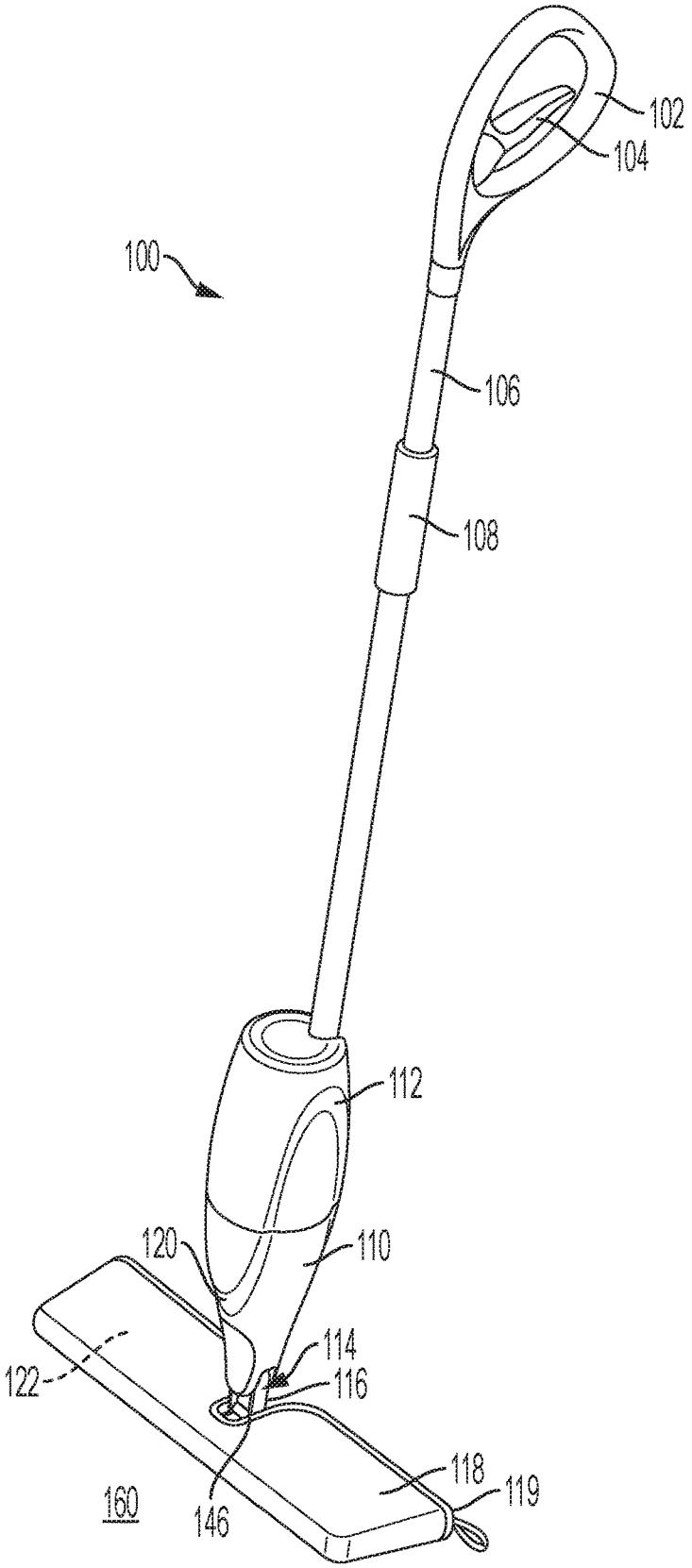
FIG. 1 is an isometric view of a spray mop according to one embodiment of the disclosure.

Referring to FIG. 1, the floor or spray mop 100 may include a handle 102, a trigger 104, a shaft 106, a grip 108, a spray housing 110, a bottle 112, a multidirectional joint 114, and a cleaning end 116 including a mop plate 122. The handle 102, which is disposed at or near the proximal end of the mop 100, can be used to grip and guide the spray mop 100 in a desired direction. The trigger 104, which is disposed in the handle 102, can be used to actuate a pump mechanism to activate the spray. The grip 108 can be coupled to the shaft 106 to provide a secondary handhold. The spray housing 110 retains the bottle 112 and connects the shaft 106 to the cleaning end 116. The bottle 112 may be filled with a cleaning fluid for cleaning a working surface or floor 160. The bottle 112 is refillable and is removably mounted to the spray housing 110 so that it can be filled with the cleaning fluid. The spray housing 110 includes a nozzle 120 generally disposed on its front surface. Fluid in the bottle 112 is communicated to a pump mechanism, which draws fluid from the bottle 112 and selectively provides a pressurized fluid flow to the spray nozzle 120. The spray nozzle 120 is generally directed forward and downward so that fluid exiting the spray nozzle 120 is sprayed onto a working surface 160 in front of the cleaning end 116 of the spray mop 100.

The cleaning end 116 includes the mop plate 122 upon which a replaceable cleaning pad 118 may be disposed. That is, the mop plate 122 is sized and shaped to receive a cleaning pad 118 (FIG. 1). The cleaning pad 118 can be any suitable type for any suitable working surface 160 to be cleaned, such as disposable or reusable cleaning pads 118 or coverings (such as microfiber cleaning pads 118). The cleaning pad 118 may be made of synthetic or natural materials or combinations thereof. The cleaning pad 118 may be shaped by two layers of fabric. Each layer of fabric may have an outer, cleaning side and an inner side. The layers are placed adjacent one another with their inner sides in facing relation, and are attached to one another, typically along at least three sides around their perimeter. The fourth side 119 is left at least partially unattached to form an internal pocket. In assembling the cleaning pad 118 to the cleaning end 116 of the mop, the mop plate 122 is placed in the pocket of the cleaning pad 118 to retain the cleaning pad 118 thereon.

An embodiment of the mop plate 122 is illustrated in detail in FIGS. 2 through 5. The mop plate 122 includes a generally planar configuration having first and second plates 132, 134 joined by a plurality of internal webs 128. The mop plate 122 includes a first face 124 and a second face 126, and lateral faces 130, 131, the faces 124, 126, 130, 131 being defined by the outer surfaces. The distance between the lateral faces 130, 131 defines a width of the mop plate 122. In the illustrated embodiment, the first and second faces 124, 126 are formed by continuous first and second plates 132, 134, although they may include one or more voids. It will be appreciated, however, that continuous first and second faces 124, 126, as illustrated, may enhance the contact of the cleaning pad 118 with a working surface 160 to be cleaned. Further, while the first and second faces 124, 126 and/or the first and second plates 132, 134 may be described as generally planar, when referring to the first and second faces 124, 126 and/or the first and second plates 132, 134, the term "planar" may include flat a slight arching. For example, while described as generally planar, the first and second faces 124, 126 may be slightly concave, causing the mop plate 122 to be thinner in its central area 136 than at the lateral faces 130, 131 (see FIGS. 4-5). Because of the concave shape of the surface of the first or second face 124, 126 that is positioned in contact with the surface 160 to be cleaned, i.e., the acting surface, the downward force tends to be higher on the surface at the radially outward periphery of the mop plate 122 and more particularly at the lateral, outer side edges of the mop plate 122 near the lateral faces 130, 131. Since the shaft 106 terminates at the multidirectional joint 114 in the central area 136 of the mop plate 122, the act of pressing down on the handle 102 may then cause the downward facing face to flatten out (if the plate is flexible) as a downward force is exerted on the center of the mop plate 122.

In order to facilitate assembly of the cleaning pad 118 to the mop plate 122, the lateral width of the mop plate 122 may be slightly smaller at front edge 138 than at a rear edge 140 of the mop plate 122. For example, the mop plate 122 may have a trapezoidal shape as viewed along the first and second faces 124, 126 (see FIG. 2). That is, the mop plate 122 may be configured with a front edge 138 that is narrower in width than a rear edge 140, the lateral faces 130, 131 angling toward each other at the front edge 138. In this way, the cleaning pad 118 may be readily assembled onto the mop plate 122, while still allowing the mop plate 122 to pivot at the multidirectional joint 114.

While a trapezoidal-shaped mop plate 122 is illustrated, those of skill in the art will appreciate that other suitable shapes may be utilized. By way of example, the mop plate 122 may have other suitable shapes such as rectangular, triangular, square, round, semi-circular, or and any other appropriate shape, so long as an complementarily-configured cleaning pad 118 may be assembled onto the mop plate 122.

In the illustrated embodiment, the lateral faces 130, 131 also include rounded surfaces, which likewise may facilitate assembly of the cleaning pad 118 onto the mop plate 122. More specifically, as may be see in FIGS. 4 and 5, the outer surfaces of the lateral faces 130, 131 are rounded. Additionally, as may be seen in FIG. 2, the lateral faces 130, 131 proximal to the front and rear edges 138, 140 are likewise rounded. These rounded shapes further facilitate assembly of the cleaning pad 118 to the mop plate 122 by minimizing the edges of the mop plate 122 upon which the cleaning pad 118 may become ensnared.

Figure 3:
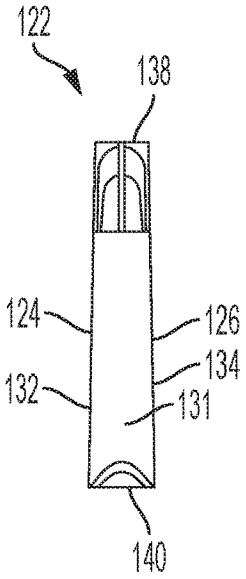
FIG. 3 is a side view of the mop plate of FIG. 2.
Figure 2:
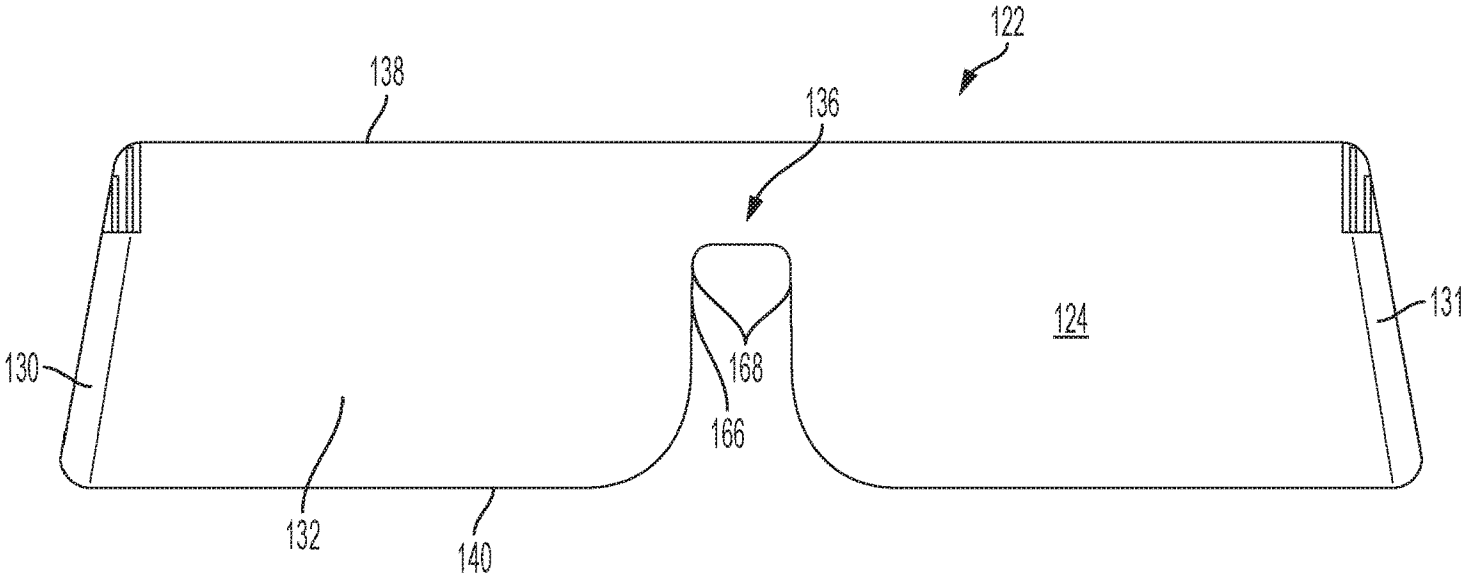
FIG. 2 is a top plan view of the mop plate of FIG. 1.
Figure 4:
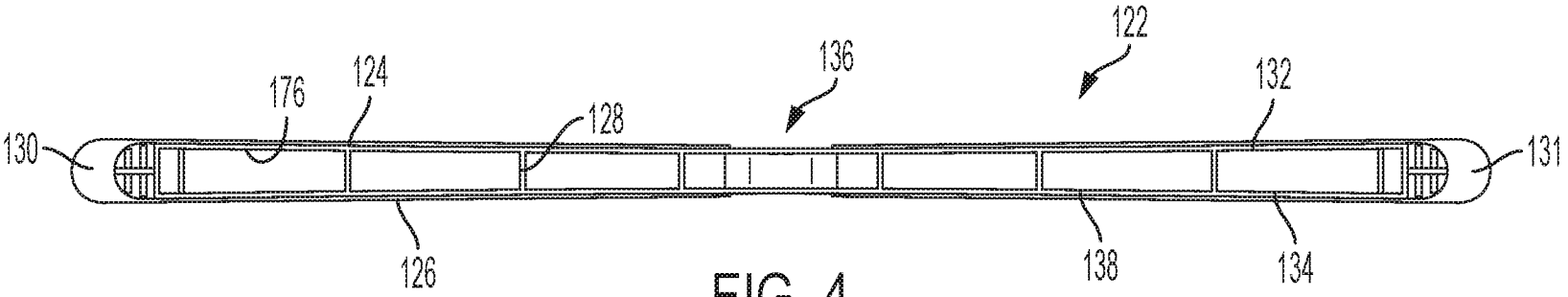
FIG. 4 is a front view of the mop plate of FIG. 2.
Figure 5:
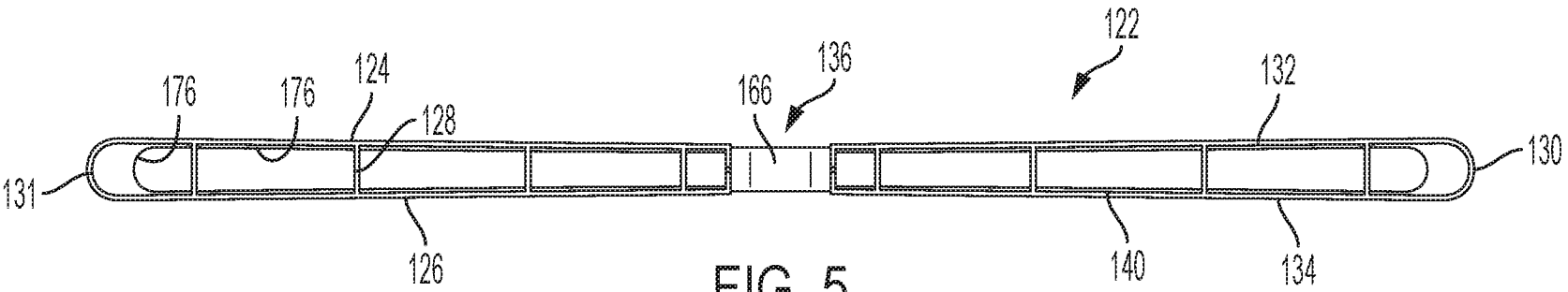
FIG. 5 is a rear view of the mop plate of FIG. 2.

Also, while the first and second faces 124, 126 are described as generally disposed in a parallel configuration, the first and second faces 124, 126 may be angled slightly toward one another such that the first and second faces 124, 126 are disposed nearer one another at the front edge 138 of the mop plate 122 than at the rear edge 140 of the mop plate 122 (see FIG. 3). Again, this narrowing of the thickness at the front edge 138 of the mop plate 122 may facilitate assembly of the cleaning pad 118 onto the mop plate 122. Those of skill in the art will appreciate that the terms "generally disposed in a parallel configuration" or "generally parallel configuration" are intended to include not only exactly parallel first and second faces 124, 126, but also configurations wherein the first and second faces 124, 126 are angled slightly toward one another, for example, as in the illustrated design.

Figure 6:
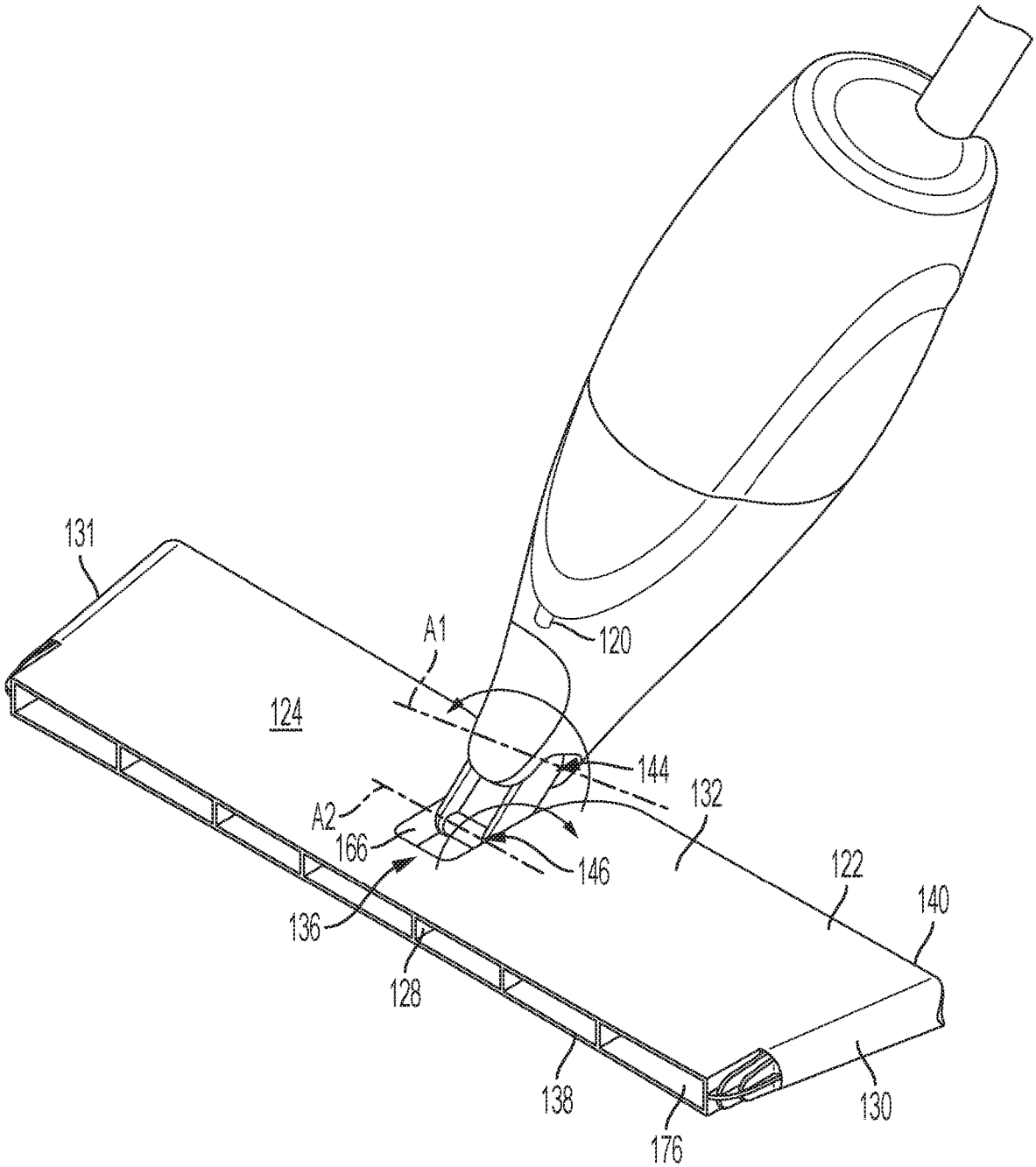
FIG. 6 is an enlarged fragmentary view of the cleaning end of the spray mop of FIG. 1.

The mop plate 122 is attached to spray housing 110 and shaft 106 by the multidirectional joint 114. The multidirectional joint 114 provides freedom of movement in multiple directions between the spray housing 110 and the cleaning end 116 such that a user can easily direct and steer the cleaning end 116 along a desired path. While other embodiments are envisioned, in the illustrated embodiment, the multidirectional joint 114 is pivotably coupled to the spray housing 110 and shaft 106 at a first pivot joint 144, and pivotably coupled to mop plate 122 at a second pivot joint 146. In this embodiment, the first pivot joint 144 of the multidirectional joint 114 allows the spray housing 110 and shaft 106 to pivot laterally relative to the cleaning end 116 about axis A1 generally along the associated arcuate path in FIG. 6. The second pivot joint 146 of the multidirectional joint 114 allows the spray housing 110 and shaft 106 to pivot about axis A2 in a fore-aft direction relative to the cleaning end 116. Those of skill in the art will appreciate that, while first and second pivot joints 144, 146 are discussed herein, the multidirectional joint 114 may be provided as a single joint that allows for a range of motion in multiple directions.

Figure 7:
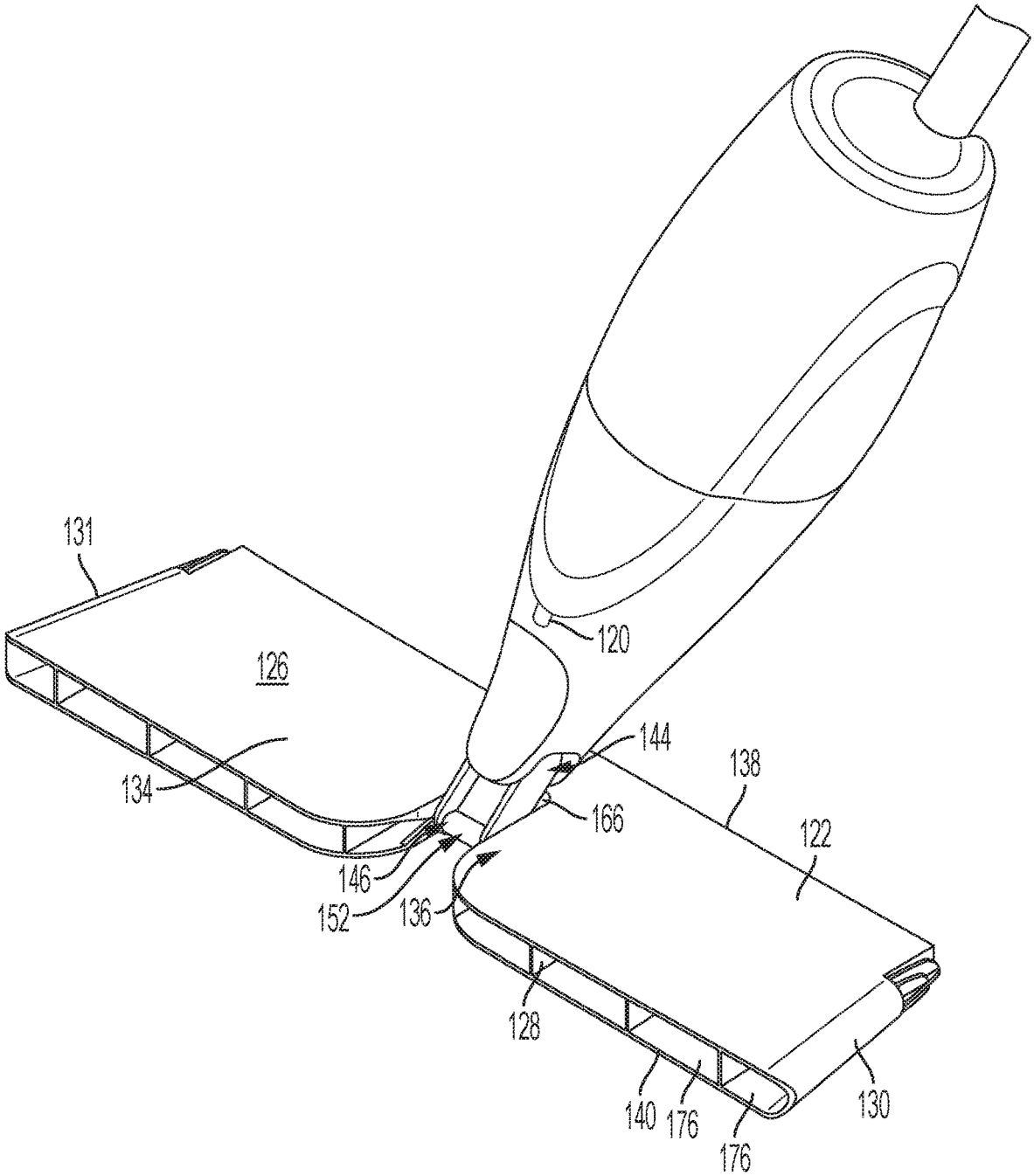
FIG. 7 is an enlarged fragmentary view of the cleaning end of the spray mop of FIG. 1 with the mop plate in a second use position.

In use of the spray mop 100, after exposing one cleaning side of the cleaning pad 118 to the working surface 160, one may utilize the other cleaning side of the cleaning pad 118 to further clean a working surface 160. To this end, either the cleaning pad 118 itself may be removed from the mop plate 122, flipped, and reassembled onto the mop plate 122, or, more conveniently, the mop plate 122, including the cleaning pad 118, can be flipped relative to the multidirectional joint 114, spray housing 110, and shaft 106 to expose the opposite of the two cleaning sides of the cleaning pad 118 to the working surface 160. In an embodiment of the invention, the multidirectional joint 114 and the mop plate 122 preferably include complementary coupling structures 152, 162 configured to permit the mop plate 122 to pivot at least 180° at the second pivot joint 146. As a result, either the first face 124 of the mop plate 122 including a first cleaning side of the cleaning pad 118 or the second face 126 of the mop plate 122 including a second cleaning side of the cleaning pad 118 may be selectively oriented to face the working surface 160 to be cleaned (see FIG. 7).

The mop plate 122, multidirectional joint 114, and complementary coupling structures 152, 162 may be of any appropriate design that permits the mop plate 122 to be pivoted relative to the spray housing 110 and shaft 106 to expose the first face 124 or the second face 126 to a surface 160 to be cleaned, some examples of which are discussed below.

Figure 8:
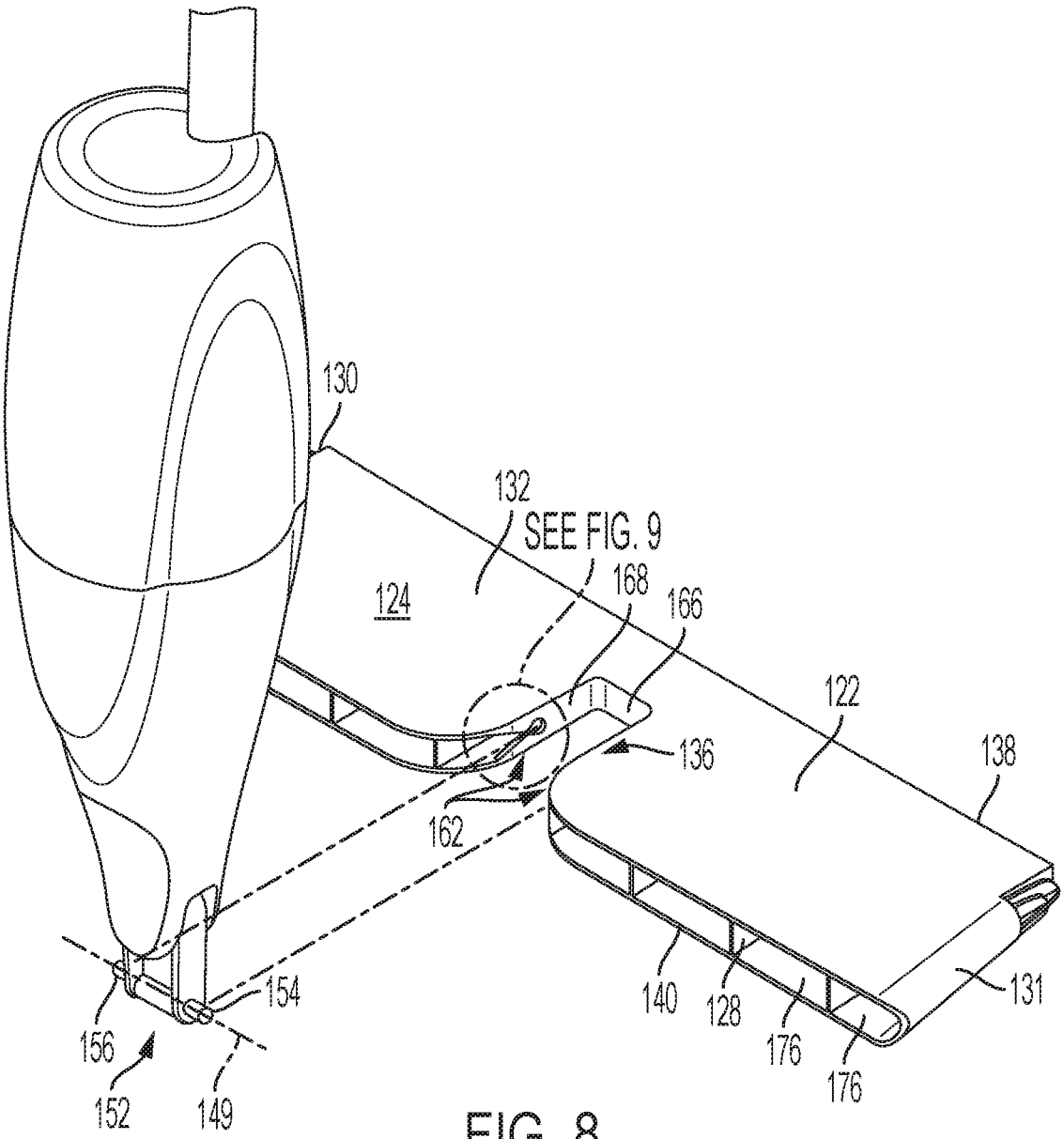
FIG. 8 is an exploded, enlarged, fragmentary, isometric view of the cleaning end of the mop of FIG. 1.

Referring to FIG. 8, a particular embodiment of the complementary coupling structures 152, 162 is illustrated. In this embodiment the complementary coupling structure 152 of the multidirectional joint 114 includes at least one connection rod, the illustrated embodiment including opposed connection rods 154, 156 that extend laterally from either side of the multidirectional joint 114. The opposed connection rods 154, 156 may be a pair of connection rods, or a single rod having the ends of the connection rod presented as the opposed connection rods 154, 156. The complementary coupling structure 162 of the mop plate 122 includes at least one channel configured to receive the at least one connection rod. The illustrated embodiment includes a pair of channels 164 formed to receive the pair of opposed connection rods 154, 156. It will be appreciated by those of skill in the art that the complementary coupling structures 152, 162 may be reversed, however. That is, the multidirectional joint 114 may include at least one channel and the mop plate 122 may include at least one connection rod.

The mop plate 122 may be generally U-shaped including a U-shaped opening 166 defined laterally across the width of the mop plate 122, typically opening to rear edge 140 of the periphery of the mop plate 122. In accordance with aspects of this disclosure, the U-shaped opening 166 may include the complementary coupling structure 162. The complementary coupling structure 162 of the illustrated mop plate 122 includes the at least one channel formed within a wall adjacent the U-shaped opening of the mop plate 122, the illustrated embodiment including the pair of channels 164 formed in the walls 168 bordering either side of the U-shaped opening 166, one such channel and one such wall being visible in the figures (see FIGS. 8 and 9). The channels 164 include an entry portion 170 and an operational portion 172. In order to retain a respective one of the connection rods 154, 156 in the operational portion 172 once assembled, the entry portion 170 and the operational portion 172 are separated by at least one restraining flange 174. The entry portion 170 allows the respective connection rods 154, 156 to be advanced to the operational portion 172. The restraining flanges 174 then maintain the associated connection rods 154, 156 in the operational portion 172 to couple the mop plate 122 to the multidirectional joint 114.

Thus, the assembly direction of the connection rods 154, 156 into the channels 164 is substantially parallel to the first and second faces 124, 126 of the mop plate 122. It will be appreciated by those of skill in the art that the assembly direction is at an angle to the positions in which the shaft 106 is disposed during typical usage. As a result, the relative structures and disposition of the complementary coupling structures 152, 162 may minimize the likelihood of the mop plate 122 separating from the multidirectional joint 114 and shaft 106 during usage.

Those of skill in the art will appreciate that the U-shaped opening 166 might alternatively include a coupling structure wherein a connection rod extends across the U-shaped opening 166 and the coupling structure of the multidirectional joint includes a channel that receives the connection rod. Alternatively, the coupling structure of the mop plate 122 may extend outward from the rear edge 140 of the mop plate 122, rather than being disposed within a U-shaped opening within the mop plate 122. In this way, the mop plate 122 may likewise be configured to pivot 180° relative to the shaft 106 and spray housing 110. Those of skill in the art will appreciate that other complementary coupling structures are envisioned.

In this way, the illustrated complementary coupling structures 152, 162 themselves permit the pivoting of the mop plate 122 to pivot relative to the multidirectional joint 114 and shaft 106. It will be further appreciated, however, that the coupling structures could be configured to secure together the mop plate 122 and the multidirectional joint 114 with a pivoting motion being provided within the multidirectional joint 114, rather than at the complementary coupling structures. By way of example only, the connection rods 154, 156 extending laterally from either side of the multidirectional joint 114 may include a cross-section that prevents rotation of the connection rods relative to the mop plate 122, such as a triangular cross-section, while the operational portion 172 of the channels 164 could include a complementary triangular shape. In such an arrangement, in order to permit fore-aft movement of the multidirectional joint 114 relative to the mop plate 122, the multidirectional joint 114 itself may then, for example, further include internal structure that facilitates fore aft pivoting of the mop plate 122.

In accordance with an aspect of some embodiments, the mop plate 122 is a unitary structure and may be formed of any appropriate material. For example, the mop plate 122 may be formed of one or more of polymeric, metal, or composite materials. The mop plate 122 may be fabricated by any appropriate method, such as molding. As a unitary structure, however, the mop plate 122 formed of a polymeric or composite material may be particularly suited for molding by any appropriate method. By way of example only, the mop plate 122 may be injection molded in a single or multiple cavity mold.

Those of skill in the art will appreciate that one or more of the structural aspects of the illustrated mop plate 122 may facilitate molding the mop plate 122 as a unitary structure, as well as enhance operation of the mop plate 122. For example, the first and second faces may be continuous structures and one or both of the front and rear edges 138, 140 of the mop plate 122 may be open, as illustrated, creating a plurality of channels 176 between the first and second faces 124, 126, internal webs 128, and lateral faces 130, 131. Those of skill in the art will appreciate that the internal webs 128 may provide strength and stability to the mop plate 122, defining the relative positions of the first and second faces 124, 126.

In an embodiment wherein the mop plate 122 is a trapezoidal shape, the wider of the front or rear edges may preferably be open to internal channels 176 formed between the plurality of internal webs 128 and between the internal webs 128 and the lateral faces 130, 131. That is, for example, in a trapazoidally shaped mop plate 122, such as the illustrated embodiment, the rear edge 140 presents the wider of the sides the trapezoidal shape of the mop plate 122. Accordingly, the internal channels 176 are preferably open to the rear edge 140 in order to facilitate molding of the mop plate 122.

Further, the first and second plates 132, 134 themselves may include a thinner structure opposite the open edge of the mop plate 122 in order to facilitate fabrication of the mop plate 122. That is, in the illustrated embodiment, the first and second plates 132, 134 may be thinner toward the front edge 138 of the mop plate 122 than the rear edge 140 of the mop plate 122. Further, it will be appreciated that rounded edges, and the increased thickness from the front edge 138 to the rear edge 140 may facilitate the unitary molding of the mop plate 122.

In an illustrative molding arrangement, a mold may include a plurality of cavities wherein cores extend from one half of the mold to maintain the plurality of channels 176 as the first and second plates 132, 134, internal webs 128, and lateral faces 130, 131 are molded between the first and second faces 124, 126. Those of skill in the art will appreciate that the unitary molding of the mop plate 122 may provide considerable cost savings in the fabrication of the mop plate 122 over designs that include a plurality of pieces that must be assembled together.

Figure 9:
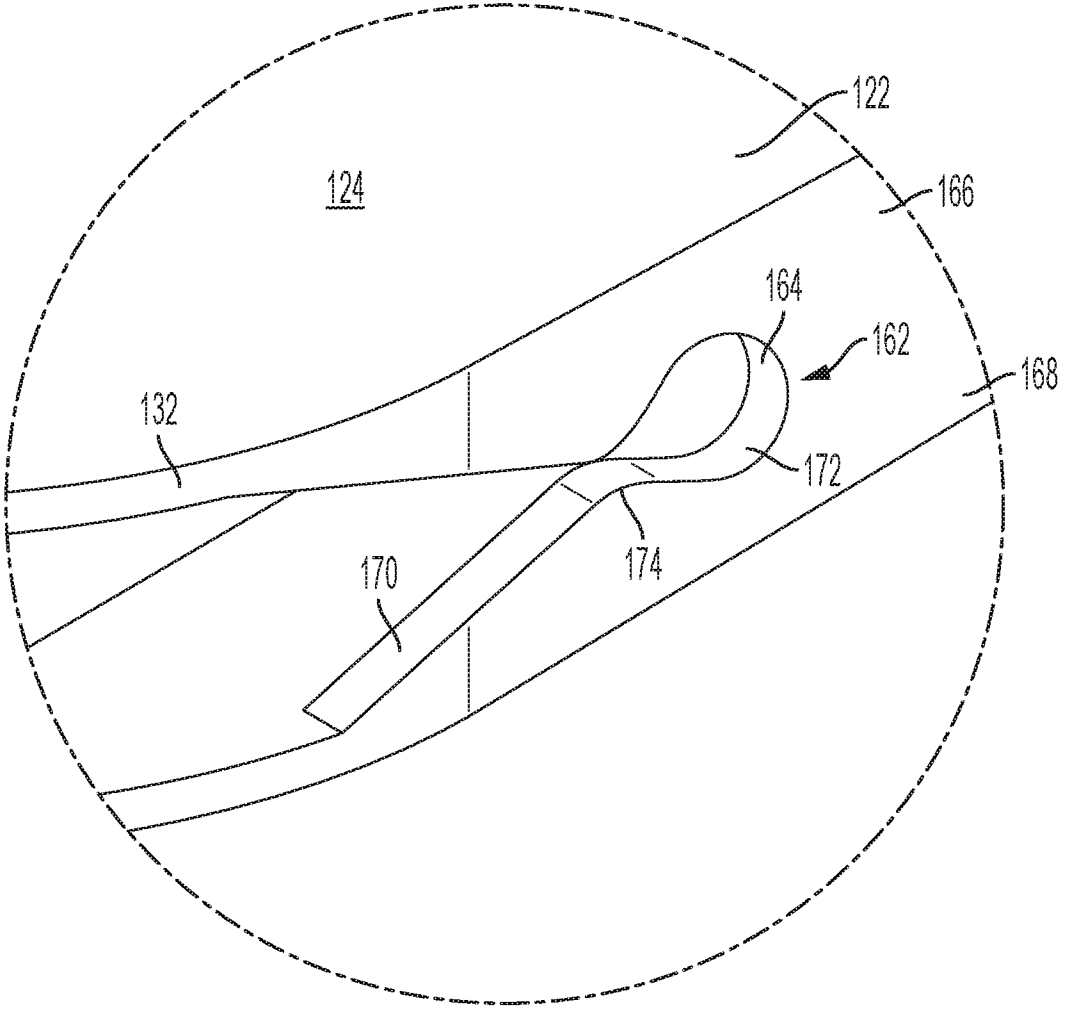
FIG. 9 is an enlarged fragmentary view of an embodiment of a complementary coupling structure of the mop plate of FIG. 1.

The spray mop 100 may include additional desirable features. For example, in order to deter undesired movement during storage or display, the spray mop 100 may include an arrangement by which the cleaning pad 118 disposed on the mop plate 122 may be temporarily coupled to the spray housing 110 in a second location (see FIG. 10). In accomplishing this objective, the cleaning pad 118 and the spray mop 100 may include complementary coupling structures adapted to couple an end of the cleaning pad 118 to the spray mop 100. As illustrated in FIG. 9, for example, the cleaning pad 118 may include a coupling structure, such as a loop 180 disposed toward one end of the cleaning pad 118, while the spray mop 100 includes a coupling structure, such as cleat 182 spaced from the multidirectional joint 114. In this way, the mop plate 122 and associated cleaning pad 118 may be pivoted to a position wherein a portion of the mop plate 122 is disposed proximal to the spray housing 110 such that the loop 180 may be disposed on the cleat 182 to hold the mop plate 122 in a position substantially parallel to the shaft 106. While the cleat 182 may extend from the spray housing 110, as illustrated in FIG. 9, those of skill in the art will appreciate that the cleat could alternatively extend from the shaft 106 or the bottle 112. Those of skill in the art will further appreciated that alternative complementary coupling structures may be provided, or the illustrated coupling structures may be reversed. For example, the spray housing 110, shaft 106, or bottle 112 may include a loop, while the cleaning pad 118 includes a hook disposed to engage the loop when the mop plate 122 is rotated to the position illustrated in FIG. 9.

Figure 10:
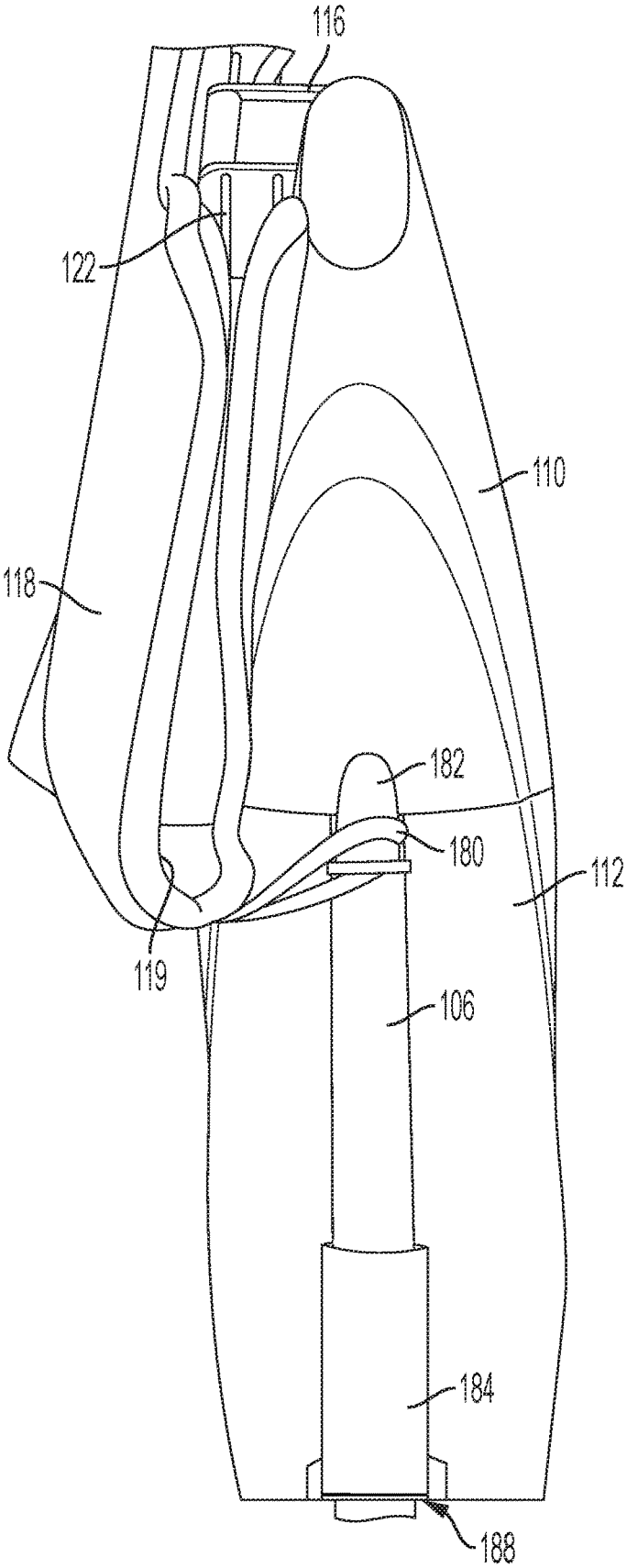
FIG. 10 is an enlarged fragmentary view of a storage position of the cleaning end of the spray mop of FIG. 1.
Figure 11:
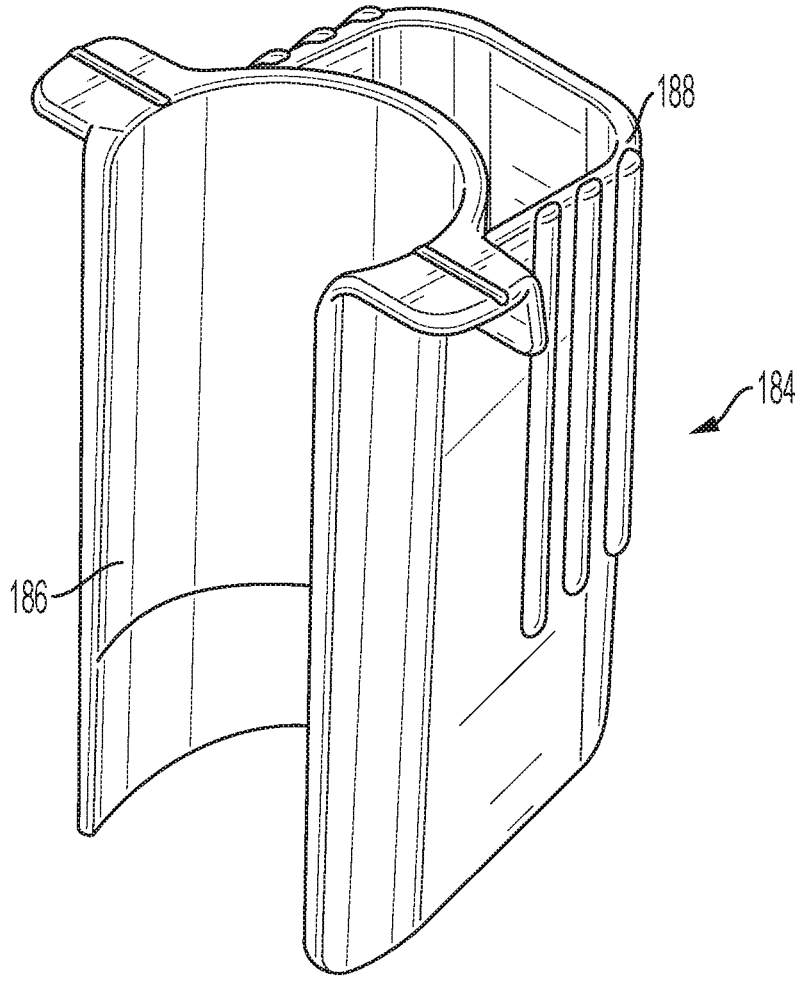
FIG. 11 is an enlarged isometric view of an embodiment of an optional measuring cup for the spray mop of FIG. 1.

By way of further example, the spray mop 100 may additionally include a measuring device to assist the consumer in preparing a cleaning solution to be utilized in the spray mop 100. Referring to FIGS. 10 and 11, a measuring cup 184 may be provided. In a particular embodiment, the measuring cup 184 is sized to provide a volume of cleaner to mixed with water to prepare enough cleaning solution to fill the bottle 112. The measuring cup 184 may be removably attached to the shaft 106, for example, by a clip 186. In at least one embodiment, the clip 186 disposes the cup 184 at a location presenting a surface 188 in substantially the same plane as a surface of the bottle 112, but on an opposed side of the shaft 106. In this way, the measuring up not only provides a convenient measuring device for the consumer, but may also be utilized to balance the spray mop 100 while hanging on a display hook.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A floor mop comprising:

a handle;

a shaft coupled to the handle;

a multidirectional joint coupled to the shaft opposite the handle; and a mop plate coupled to the multidirectional joint, the mop plate having an upper plate, a lower plate substantially parallel to the upper plate, lateral faces extending between the upper and lower plate, and at least one internal web extending between the upper and lower plates, the upper plate including an upper surface, the lower plate including a lower surface, wherein the upper plate, the lower plate, the lateral faces and the at least one internal web are unitarily formed, the mop plate including a front edge and a rear edge, the mop plate including a U-shape defined laterally across a width of the mop plate and defining a U-shaped opening, the U-shaped opening being disposed toward the rear edge of the mop plate, the mop plate and the multidirectional joint including complementary coupling structures, wherein the complementary coupling structure of the multidirectional joint includes a pair of opposed connection rods, and the complementary coupling structure of the mop plate includes a pair of channels, the mop plate including opposed walls bordering the U-shaped opening, the pair of channels being formed within the opposed walls bordering the U-shaped opening.

2. The floor mop of claim 1 wherein the upper surface is substantially continuous, and the lower surface is substantially continuous.

3. The floor mop of claim 1 wherein the at least one internal web includes a plurality of internal webs forming channels between the internal webs and the upper and lower plates.

4. The floor mop of claim 3 wherein the plurality of internal webs extend in a direction between the front and rear edges.

5. The floor mop of claim 1 wherein each of said channels includes an entry portion, an operational portion, and at least one restraining flange, the entry portion and the operational portion being separated by the at least one restraining flange.

6. The floor mop of claim 1 wherein the complementary coupling structures pivotably couple the mop plate to the multidirectional joint, the complementary coupling structures permitting the mop plate to pivot at least 180° relative to the multidirectional joint.

7. The floor mop of claim 1 wherein the mop plate wherein the mop plate includes a plurality of rounded edges.

8. The floor mop of claim 1 wherein the mop plate includes a plurality of internal webs extending between the upper and lower plates, the plurality of internal webs extending in a direction between the front and rear edges and being disposed substantially parallel one another, the plurality of internal webs forming channels between the internal webs and the upper and lower plates, the channels opening to at least one of the front and rear edges, wherein the upper plate, the lower plate, the lateral faces and the internal webs are unitarily formed.

9. The floor mop of claim 8 wherein the mop plate is formed of one or more of polymeric, metal, and composite materials.

10. The floor mop of claim 8 wherein the plurality of internal webs extend substantially perpendicularly to at least one of the front edge and the rear edge of the mop plate.

11. The floor mop of claim 8 wherein the upper surface is substantially continuous, and the lower surface is substantially continuous.

12. A floor mop comprising:

a handle;

a shaft coupled to the handle;

a multidirectional joint coupled to the shaft opposite the handle;

a mop plate coupled to the multidirectional joint, the mop plate having an upper plate, a lower plate substantially parallel to the upper plate, lateral faces extending between the upper and lower plate, and at least one internal web extending between the upper and lower plates, the upper plate including an upper surface, the lower plate including a lower surface, wherein the upper plate, the lower plate, the lateral faces and the at least one internal web are unitarily formed, the mop plate and the multidirectional joint including complementary coupling structures;

a cleat, the cleat being spaced from the multidirectional joint, the multidirectional joint being adapted to allow the mop plate to pivot to a position wherein the mop plate is disposed substantially parallel to the shaft, the cleat being adapted to further couple the mop plate to the shaft in a position substantially parallel to the shaft; and a cleaning pad disposed on the mop plate, the cleaning pad including a loop disposed to engage with the cleat to couple the mop plate to the shaft in the position substantially parallel to the shaft.

13. A floor mop comprising:

a handle;

a shaft coupled to the handle;

a measuring cup removably attached to the shaft;

a multidirectional joint coupled to the shaft opposite the handle; and a mop plate coupled to the multidirectional joint, the mop plate having an upper plate, a lower plate substantially parallel to the upper plate, lateral faces extending between the upper and lower plate, and at least one internal web extending between the upper and lower plates, the upper plate including an upper surface, the lower plate including a lower surface, wherein the upper plate, the lower plate, the lateral faces and the at least one internal web are unitarily formed, the mop plate and the multidirectional joint including complementary coupling structures.

14. The floor mop of claim 13 wherein the mop plate has a U-shape defined laterally across a width of the mop plate.

15. The floor mop of claim 14 wherein the mop plate includes a front edge and a rear edge, and the U-shape of the mop plate defines a U-shaped opening, the U-shaped opening being disposed toward the rear edge of the mop plate, the U-shaped opening including the complementary coupling structure of the mop plate.

16. The floor mop of claim 13 wherein the complementary coupling structures include at least one connection rod and at least one channel adapted to receive the at least one rod.

17. The floor mop of claim 13 wherein the multidirectional joint allows the mop plate to pivot substantially 180° relative to the handle to dispose either of the upper plate and the lower plate in a lowermost position.

* * * * *